US006823814B2

(12) United States Patent
Bukky

(10) Patent No.: US 6,823,814 B2
(45) Date of Patent: Nov. 30, 2004

(54) REFLECTIVE MARKER

(76) Inventor: Theodore Bukky, P.O. Box 829, Chardon, OH (US) 44024-0829

( * ) Notice: Subject to any disclaimer, the term of this patent is extended or adjusted under 35 U.S.C. 154(b) by 0 days.

(21) Appl. No.: 09/962,421

(22) Filed: Sep. 25, 2001

(65) Prior Publication Data

US 2002/0035959 A1 Mar. 28, 2002

Related U.S. Application Data

(60) Provisional application No. 60/235,559, filed on Sep. 27, 2000.

(51) Int. Cl.[7] ..... E01F 9/011

(52) U.S. Cl. ..... 116/209; 116/202; 116/63 P; 52/103; 52/104; 40/612; 404/9; 248/530

(58) Field of Search ..... 116/202, 209, 116/63 R, 63 P, DIG. 16; 52/103, 104, 155, 153, 165; 40/612, 606, 607, 582, 608; 404/9–11; 248/530, 542, 156

(56) References Cited

U.S. PATENT DOCUMENTS 492,520 A * 2/1893 Hedges ..... 52/156
661,830 A * 11/1900 Webster ..... 52/104
2,237,456 A * 4/1941 Stambaugh, Jr. ..... 359/552
2,554,887 A * 5/1951 Tricarico ..... 248/545
3,195,898 A * 7/1965 Respini ..... 473/197
3,802,378 A 4/1974 Kessler
3,860,213 A 1/1975 Heenan
4,290,712 A 9/1981 Hayes
D261,401 S * 10/1981 Collis ..... D21/41
4,779,955 A * 10/1988 Schmanski ..... 350/97
5,026,061 A * 6/1991 Davis ..... 273/177 R
5,375,801 A * 12/1994 Porter ..... 248/156
6,123,311 A * 9/2000 Trinier ..... 248/530
6,220,200 B1 * 4/2001 Howard et al. ..... 116/209

* cited by examiner

*Primary Examiner*—Diego Gutierrez
*Assistant Examiner*—Tania C. Courson
(74) *Attorney, Agent, or Firm*—Hahn Loeser & Parks LLP; W. Edward Crooks, Esq.

(57) ABSTRACT

The reflective marker allows a user to easily place the invention in a desired location without damaging the housing or structure of the marker. More specifically, the reflective marker that contains a foot cleat allowing a user to foot pressure to the cleat or to strike the cleat with a mallet/hammer to drive the invention into the ground. As a result, force is not exerted on the marker's external housing or marker's reflector, and the reflector's aesthetic appeal, structural integrity and reflecting capacity are kept intact. The reflective marker has a primary and a secondary anchor spike for securing the device in the ground.

21 Claims, 2 Drawing Sheets

REFLECTIVE MARKER

This application claims the benefit of U.S. Provisional application No. 60/235,559, filed Sep. 27, 2000. The present invention relates to a device for marking an edge of a driveway, a walkway or the like, where a user desires to indicate the existence of a boundary region. Specifically, the device uses a plurality of light-reflecting portions oriented in an multi-directional configuration, thereby rendering it visible from a variety of approach angles. Furthermore, the invention incorporates a plurality of spike portions connected by a cleat member, the cleat member providing a surface for driving the spike portions into the ground.

BACKGROUND OF THE ART

Driveway reflectors typically only provide reflectivity on one or two faces of the reflecting device. As a result, when a reflector is approached at an angle where a reflector is not directly oriented, the reflectivity is attenuated. Furthermore, drive-way type reflectors often require that force be placed on the housing containing the reflecting portion or on the shaft in order to drive the reflector into the ground. This force can result in the cracking or degradation of the reflecting portion, as well as the deformation of the reflector housing itself, thereby reducing the marker's reflective effectiveness, as well as making the marker aesthetically unappealing, and less structurally sound.

When a rigid shaft is used that allows the shaft to be directly driven into the ground, that same rigidity poses a damage risk to vehicles that might strike the device. A number of rigid marker devices have been developed that possess sufficient column strength to be driven into the ground. For example, one such device requires that force be applied directly to the reflective portion to drive the unit into the ground. Another such device requires a rigid pipe of the like to be fitted over the length of the device, an end of the pipe bearing against a radially extending flange at the base of the device. That device is driven into the ground by applying force to the pipe as it surrounds the device. This, however, requires that the reflective head have a relatively small cross sectional area, to permit the pipe to fit around the reflective head.

The prior art generally teaches only the use of a single ground penetrating spike for securing the reflective marker.

Therefore, in light of the foregoing deficiencies in the prior art, the applicant's invention is herein presented.

SUMMARY OF THE INVENTION

This object and other objects are achieved by device for marking an edge of a driveway or the like. The device comprises a shaft member, a head member and a ground anchor member. The shaft member has a first and a second end and an intermediate portion therebetween, the intermediate portion defining a longitudinal axis. The head member has a first end connected to the first end of the shaft member. The ground anchor comprises a cleat member, connecting means and a first and a second anchor spike. The cleat member extends radially outward from the longitudinal axis of the shaft member, with the connecting means connecting a first end of the ground anchor to a second end of the shaft member, on a first side of the cleat member. The first and a second anchor spike extend in parallel relationship from a second side of the cleat member.

In some embodiments, the first anchor spike is coaxial with the connecting means.

In some embodiments, the first anchor spike and the connecting means extend from near a first end of the cleat member and the second anchor spike extends from near a second end of the cleat member.

In many of the embodiments, the second anchor spike is shorter than the first spike portion.

In the typical device, the intermediate portion of the shaft member has a polygonal cross-section, including a circular cross section.

In some of the embodiments, the head member comprises a plurality of face surfaces, each said face surface having at least one reflective portion affixed thereto.

In other embodiments, a second end of the head member has a removable cap affixed thereto, wherein the removable cap allows replacement of the reflective portions.

In most of the embodiments, the head member has a rectangular cross-section.

BRIEF DESCRIPTION OF THE DRAWINGS

A better understanding of the present invention will be had when reference is made to the accompanying drawings, wherein identical parts are identified by identical reference numerals and wherein.

DETAILED DESCRIPTION OF THE PREFERRED EMBODIMENT

Figure 1:
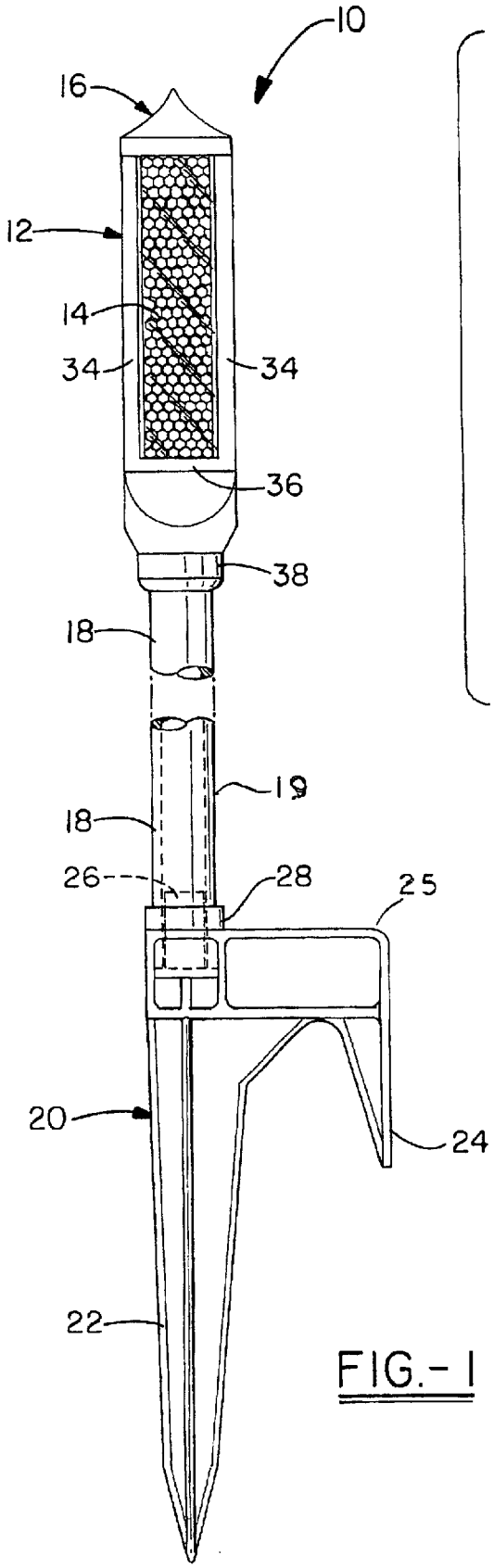
FIG. 1 is an elevational view of a reflective marker according to the present invention wherein a portion of an intermediate shaft is broken away to indicate a shaft which may be of any length.

FIG. 1 shows an elevational view of a reflective marker device 10 of the present invention. The device 10 has a head member 12, with a plurality of reflective portions 14 and a top end cap 16. Attached at a lower end of the head member 12 is a shaft member 18 with first and second ends and an intermediate portion 19 between the two ends. The intermediate portion 19 defines a longitudinal axis for the device 10. The lower end of the head member 12 is attached to the first end of the shaft member 18.

A ground anchor, shown generally as 20 in FIG. 1, is attached to the shaft member 18 at the second end of the shaft member. An alternate embodiment of the ground anchor is shown generally as 20' in FIG. 6. The ground anchor 20 comprises a primary or first anchor spike 22 and a secondary or second anchor spike 24. Of these, the first anchor spike 22 extends essentially coaxially as an extension of the longitudinal axis of the shaft member 18. The secondary anchor spike 24, which is typically shorter than the first anchor spike 22, is spaced apart from the first anchor spike and is maintained in a spaced-apart parallel relationship by cleat member 25 that extends radially outwardly from the longitudinal axis of the shaft member. Both of the anchor spikes 22, 24 are formed on and extend from a second or lower side of the cleat member 25. Particularly, the primary or first anchor spike 22 is positioned at a first end of the cleat member 25 and the secondary anchor spike 24 is positioned at a second end thereof.

Figure 5:
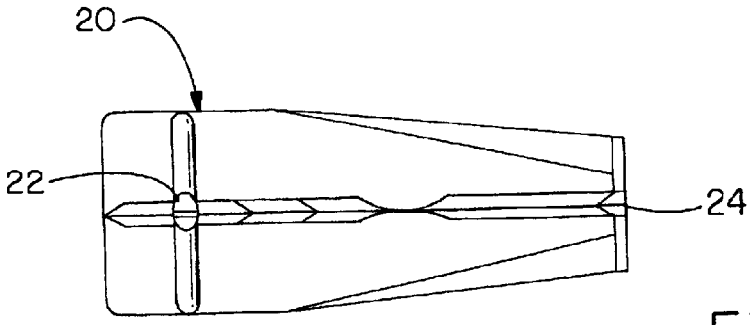
FIG. 5 is a bottom end view of the ground anchor portion of the reflective marker.
Figure 6:
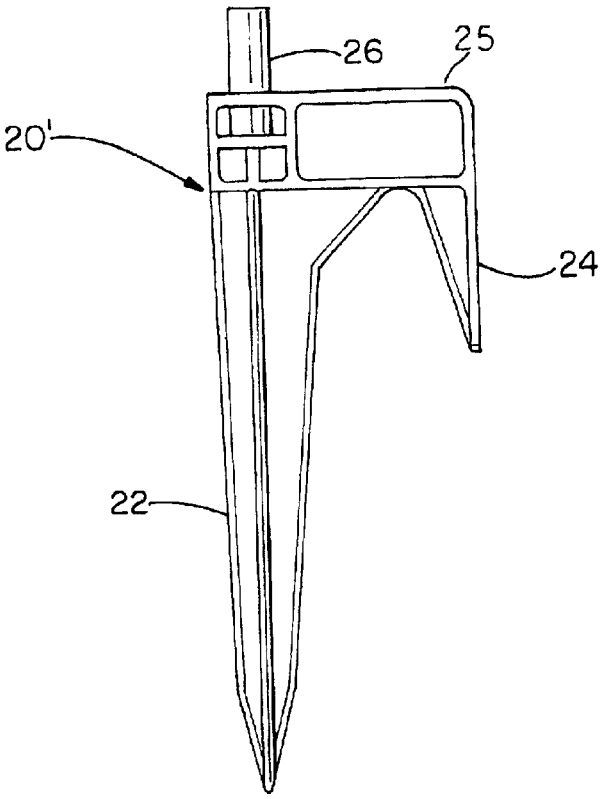
FIG. 6 is an elevational view of an alternative embodiment for the ground anchor.

The upper or first side of the cleat member 25 is located at a top of the ground anchor 20, as clearly shown in FIGS. 1 and 6, in which the alternate embodiment is shown. In the embodiment of FIG. 1, the ground anchor 20 is attached to the shaft member 18 by providing a shaft receiving stud 26 and a shaft receiving boss 28, the stud and boss coacting to define an annular space into which the shaft end is at least frictionally retained. In many embodiments, the shaft end will be adhesively retained in this annular space and in other embodiments, the shaft may be thermally welded into place. These connnecting means 26, 28 are located on a first or upper side of the cleat member 25. In the alternate embodiment of FIG. 6, the ground anchor 20' has a connecting means which has the same shaft receiving stud 26, but it lacks the shaft receiving boss 28. Other connecting means will be known to those of skill in this art. In both embodiments, the primary anchor spike 22 is axially aligned with the shaft receiving stud 26, so that placing the shaft receiving stud inside the lower end of the shaft member 18 puts the primary anchor spike into coaxial alignment with the shaft member. It will be recognized that the bottom view of the ground anchor 20 in FIG. 5 applies equally well to alternative embodiment 20'.

Figure 2:
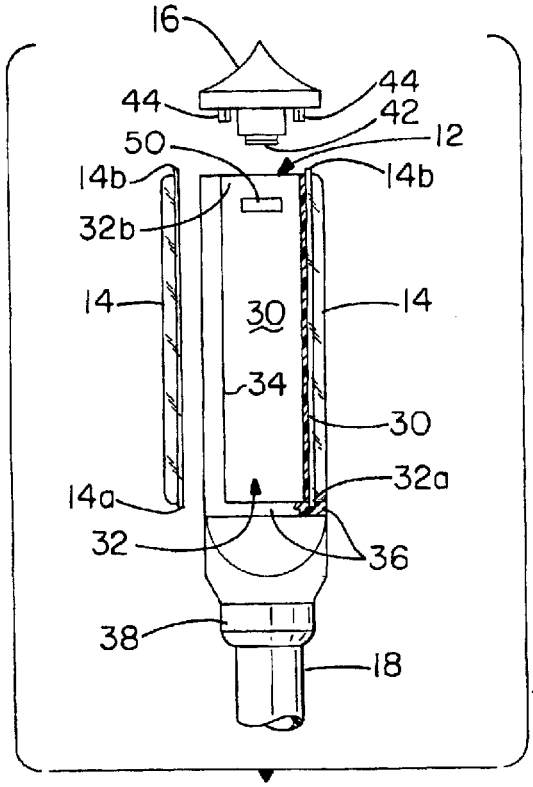
FIG. 2 is an elevational view of the reflective marker main portion with parts broken away and in cross section and various members in assembly position for the purpose of the description.
Figure 4:
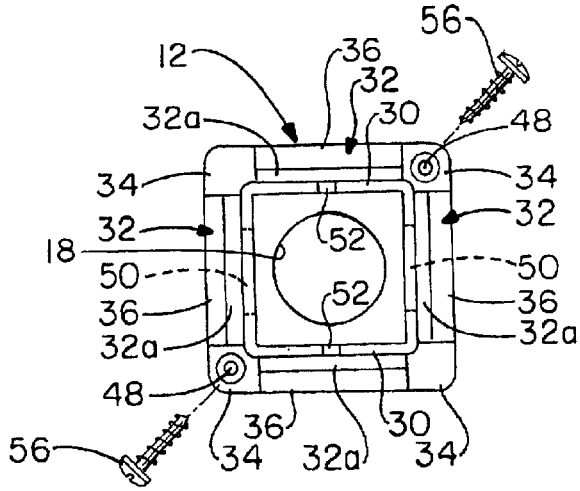
FIG. 4 is a top view of the reflective marker body with the cap removed.

Attention is now directed to FIGS. 2 and 4, which focus on the head member 12. The head member 12 has a plurality of marker body walls 30 that define lens receiving cavities 32. In the particular embodiment shown, there are four such marker body walls 30 in a rectangular relationship, as well as four lens receiving cavities 32. In addition to marker body walls 30, the cavities 32 are also defined by side posts 34 of the head member 12. The cavities 32 are even further defined by a bottom wall 36 at the lower extent of each marker body wall 30. Each of the cavities 32 further has a recess 32*a* at its bottom end, defined by the bottom wall 36 and an open end 32*b* which is at the top end of the head member 12. At the lower end of the head member 12, a connecting means 38 is provided to attach the head member to the shaft member 18. In the embodiment shown, the connecting means 38 is a shaft receiving boss which can be at least frictionally engaged with the first end of the shaft member 18, although it would be clear to one of ordinary skill to adhesively retain this engagement, or to thermally weld the pieces together, or to engage them by other known means. In viewing this embodiment shown in FIGS. 1 and 2, it will be noted that the head member 12 has a cross sectional area (relative to the shaft 18) that is very close to that of the shaft. However, by providing the unique ground anchor 20 of the device 10, it is possible to let the head member 12 be much larger in cross sectional area relative to the shaft 18, as there is no need to use a pipe or tube fitted over the device to drive it into the ground, as it required in at least one of the prior art devices.

FIG. 2 shows aspects of the reflective portions 14, which are seen in side view. A face view of one reflective portion is seen in FIG. 1. This face view provides a face surface of the reflective portion 14. In FIG. 2, it will be seen that each reflective portion 14 has an lower lip 14*a* and an upper lip 14*b*. These lips 14*a*, 14*b* are used to secure the reflective portion 14 into the cavity 32. These reflective portions may be of many types, although the specific type illustrated is a colored plastic piece with a planar front surface and a rear surface that is faceted to reflect light. Such a material is commonly available and will be readily known to one of skill in this art.

Figure 3:
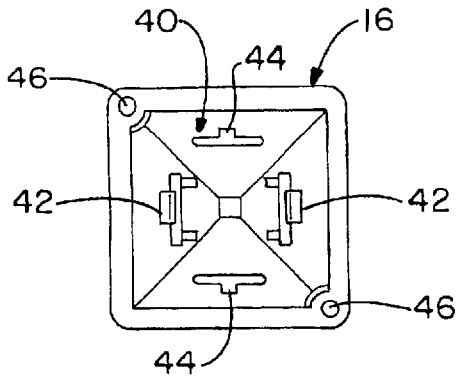
FIG. 3 is a bottom inside view of a cap member showing attachment and alignment means for securing the cap on the top end of the reflective marker body.

The cap 16 of the device 10 is shown in FIGS. 2 and 3. The cap 16 has an interior 40. On that interior 40 are a pair of keyed protrusions 42 and a pair of alignment protrusions 44. In the rectangular embodiment of the head member 16 illustrated, the keyed protrusions 42 are positioned oppositely to each other. The alignment protrusions 44 are also positioned opposite to each other, in perpendicular relationship to the keyed protrusions 42. The cap 16 also has a pair of screw receiving bores 46.

These latter features of the cap 16 are understood when reference is again made to FIGS. 2 and 4. A pair of protrusion receiving bores 50 are shown on opposite walls 30 of the head member 12 for capturing keyed protrusions 42 of the cap 16. A pair of slots 52 in opposing walls 30 of the head member 12 are shown for capturing alignment protrusions 44usions of the cap 16. Also, screw receiving bores 48 in the head member 12 correspond to screw receiving bores 26 in the cap 16. All of these pieces coact to secure the cap 16 atop the head member. Of course, cap 16 has an outer peripheral surface that serves to provide the final defining edge of cavity 32, so that the reflective lenses 14 are retained in place, but in a manner that allows access to the reflective lenses 14 and replacement thereof when necessary.

While the embodiment taught herein has a head member 16 with a rectangular cross-section, the shape of the head member 16 may be cylindrical, square, triangular, hexagonal, or any other shape suitable for housing a plurality of reflecting portions.

It is also contemplated that a user may remove and insert reflective portions 14 having various colors or reflective characteristics into the any of the cavities 32. After the reflective portions 14 are inserted, the user can replace the cap 16 and the reflector portions 14 are held in position thereby. By locating the reflecting portions 14 on each of four faces of the head member 16, the device 10 provides multi-directional reflectivity, thereby alerting a person of the marker when approached from a plurality of angles.

Because the shaft member 18 is not relied upon to be able to drive the device into the ground, the shaft member does not have to be made of metal or of a similarly strong material. Instead, the shaft member 18 can be relatively flexible so that it will not damage a vehicle if struck, or, alternatively, it will tend to be more resistant to damage from a vehicle if struck. Rigid shafts of the prior art devices would either damage a vehicle that struck them or they would be severely damaged (even broken) by a vehicle striking it. For these reasons, many embodiments of the shaft will be hollow tubes, especially hollow tubes of a thermoplastic material.

The ground anchor 20 or 20', and particularly cleat 25, provide the user with a surface region suitable for driving the primary and secondary anchor spikes 22, 24 into the ground. Additionally, the cleat 25 provides the user with a sufficient surface to use a hammer/mallet or similar device, to drive the primary and secondary anchor spikes 22, 24 into the ground. By inserting both anchor spikes 22, 24 into the ground, the reflecting marker 10 resists rotating around the longitudinal axis of shaft 18. Additionally, the use of both primary and secondary anchor 22, 24 permits the device 10 to achieve a high degree of lateral rigidity, thereby increasing its resistance to disturbances created by external environmental forces such as wind, snow, etc.

In some embodiments, the head member 12, shaft member 18, and ground anchor 20 are formed as an integral piece, although this is not as easily achieved while keeping the shaft member as a hollow tubular member. Additionally, any two contiguous pieces such as the head portion 16 and shaft member 18, or the shaft member 18 and the ground anchor 20 may be formed as a single unified section.

The foregoing disclosure is illustrative of the present invention and is not to be construed as limiting thereof. Although one or more embodiments of the invention have been described, persons of ordinary skill in the art will readily appreciate that numerous modifications could be made without departing from the scope and spirit of the disclosed invention. As such, it should be understood that all such modifications are intended to be included within the scope of this invention. The written description and drawings illustrate the present invention and are not to be construed as limited to the specific embodiments disclosed.

What is claimed is:

1. A device for marking an edge of a driveway or the like, comprising:

a shaft member, having a first and a second end and an intermediate portion therebetween, the intermediate portion defining a longitudinal axis;

a head member, having a first end attached to the first end of the shaft member; and a ground anchor comprising:

a cleat member extending radially outward from the longitudinal axis of the shaft member;

a means for permanently attaching the ground anchor to the second end of the shaft member, on a first side of the cleat member; and a first and a second anchor spike extending in parallel relationship from a second side of the cleat member.

2. The marking device of claim 1, wherein the first anchor spike is coaxial with the connecting attaching means.

3. The marking device of claim 2, wherein the first anchor spike and attaching means extend from near a first end of the cleat member and the second anchor spike extends from near a second end of the cleat member.

4. The marking device of claim 1, wherein the second anchor spike is shorter than the first spike portion.

5. The marking device of claim 1, wherein a second end of the head member has a removable cap affixed thereto.

6. The marking device of claim 5, wherein the removable cap facilitates replacement of the reflective portions.

7. The marking device of claim 1, wherein the head member has a rectangular cross-section.

8. A device for marking an edge of a driveway or the like, comprising:

a shaft member, having a first and a second end and an intermediate portion with a circular cross section therebetween, the intermediate portion defining a longitudinal axis;

a head member, having rectangular cross section with a first end attached to the first end of the shaft member, the head member comprising a plurality of face surfaces, each said face surface having at least one reflective portion affixed thereto, a second end of the head member having a removable cap affixed thereto which allows replacement of the reflective portions; and a ground anchor comprising:

a cleat member extending radially outward from the longitudinal axis of the shaft member;

a means for permanently attaching a first end of the ground anchor to a second end of the shaft member, on a first side of, and near a first end of, the cleat member; and a first and a second anchor spike extending in parallel relationship from a second side of the cleat member, the first anchor spike being coaxial with the connecting means, the first anchor spike extending from near the first end of the cleat member and the second anchor spike extending from near a second end of the cleat member, wherein the second anchor spike is shorter than the first anchor spike.

9. A reflective marker, comprising:

a shaft member having a first end, a second end, and a longitudinal axis;

a head member having a first end and a second end, the head member first end being attached to the shaft member first end, the head member having at least one reflective portion selectively connected thereto; and, a ground anchor permanently attached to the second end of the shaft member, the ground anchor comprising a cleat member extending substantially perpendicular to the longitudinal axis of the shaft member and having first and second anchor spikes extending from the cleat member and being adapted for insertion into a ground.

10. The reflective marker as recited in claim 9, wherein the head member further comprises a removable cap on the second end of the head member.

11. The reflective marker as recited in claim 10, wherein the removable cap facilitates replacement of the at least one reflector.

12. The reflective marker as recited in claim 9, wherein the first spike member extends coaxially to the shaft member.

13. The reflective marker as recited in claim 9, wherein the first and second anchor spikes extend parallel to the shaft member.

14. The reflective marker as recited in claim 9, wherein, the ground anchor is permanently attached to the shaft member near a first end of, and on a first side of, the cleat member, and the first anchor spike extends from near the first end of, and from a second side of, the cleat member.

15. The reflective marker as recited in claim 14, wherein, the second anchor spike extends from near a second end of, and from a second side of, the cleat member.

16. The reflective marker as recited in claim 9, wherein at least a portion of the head member has a rectangular cross-section.

17. The reflective marker as recited in claim 9, wherein the second anchor spike is shorter than the first anchor spike.

18. The reflective marker as recited in claim 9, wherein, at least a portion of the head member has a rectangular cross-section, the ground anchor is permanently attached to the shaft member near a first end of, and on a first side of, the cleat member, the first anchor spike extends from near the first end of, and from a second side of, the cleat member, the first anchor spike being coaxial with the shaft member, the second anchor spike extends from near a second end of, and from the second side of, the cleat member, the second anchor spike being shorter than the first anchor spike, and wherein, the first and second anchor spikes extend substantially parallel to the shaft member.

19. The reflective marker as recited in claim 18, wherein the head member further comprises a removable cap on the second end of the head member.

20. The reflective marker as recited in claim 19, wherein, when the removable cap is engaged with the head member, the at least one reflector is attached to the head member, and, when the removable cap is removed from the head member, the at least one reflector is removable from the head member.

21. A reflective marker, comprising:

a shaft member having a first end, a second end, and a longitudinal axis;

a head member having a first end and a second end, the head member first end being attached to the shaft member first end, the head member having at least one reflective portion selectively connected thereto; and, a ground anchor attached to the second end of the shaft member, the ground anchor comprising a cleat member extending substantially perpendicular to the longitudinal axis of the shaft member and having first and second anchor spikes extending from the cleat member and being adapted for insertion into a ground, wherein the second end of the head member has a removable cap affixed thereto, the removable cap facilitating replacement of the at least one reflective portion.

* * * * *